United States Patent [19]

Taub

[11] 4,111,299

[45] Sep. 5, 1978

[54] DEFORMABLE CONTAINER

[76] Inventor: David Taub, 1387 E. 46th St., New York, N.Y. 11234

[21] Appl. No.: 741,682

[22] Filed: Nov. 15, 1976

[51] Int. Cl.[2] ..... B65D 85/54

[52] U.S. Cl. ..... 206/215; 206/45.13; 206/45.26; 206/425; 206/449; 206/564; 229/30; 229/27

[58] Field of Search ..... 206/215, 248, 45.13, 206/45.26, 256, 409, 425, 449, 814, 494, 564; 229/30, 27, 15

[56] References Cited

U.S. PATENT DOCUMENTS

| | | | |
|---|---|---|---|
| 1,909,472 | 5/1933 | Keppler | 206/45.26 |
| 2,542,882 | 2/1951 | Shumway | 206/814 |
| 3,013,710 | 12/1961 | Kronson et al. | 229/41 B |
| 3,174,674 | 3/1965 | Wagner | 206/564 |
| 3,322,478 | 5/1967 | Brown | 312/259 |
| 3,908,821 | 9/1975 | Lambert et al. | 206/425 |

FOREIGN PATENT DOCUMENTS

| | | | |
|---|---|---|---|
| 1,173,963 | 12/1969 | United Kingdom | 229/37 R |

*Primary Examiner*—William Price
*Assistant Examiner*—Joseph M. Moy
*Attorney, Agent, or Firm*—Norbert P. Holler

[57] ABSTRACT

A new deformable container is disclosed, suitable for use in packaging items of different dimensions. In use, portions of the container are deformed to provide abutments at the interior of the container for fixing therein the relative position of the items of different dimensions. The container is generally rectangular and is made of sheet material, for example, cardboard. In the preferred form, the container is used in conjunction with a detachable cover and with such cover forms a closed rectangular box. When the cover is detached from the container, two pairs of tabs are exposed. These pairs of tabs are located respectively at opposite longitudinal ends of the container. One tab in each pair is coplanar with and hingedly connected to the front wall of the container while the other tab of each pair is hingedly connected to and coplanar with the corresponding side wall of the container. The tabs forming each such pair of tabs are also hingedly connected to one another such that each pair of connected tabs is deformable from its initial position in which the tabs are respectively coplanar with the front wall and the corresponding side wall, into a final position in which the tabs are located in the interior of the container. In such final position each pair of tabs provides both a longitudinal and a transverse abutment at the interior of the container and the abutments thus provided by both pairs of tabs cooperate to position in the interior of the container articles of different size, for example, stacks of envelopes of different lengths.

13 Claims, 14 Drawing Figures

Fig. 1.
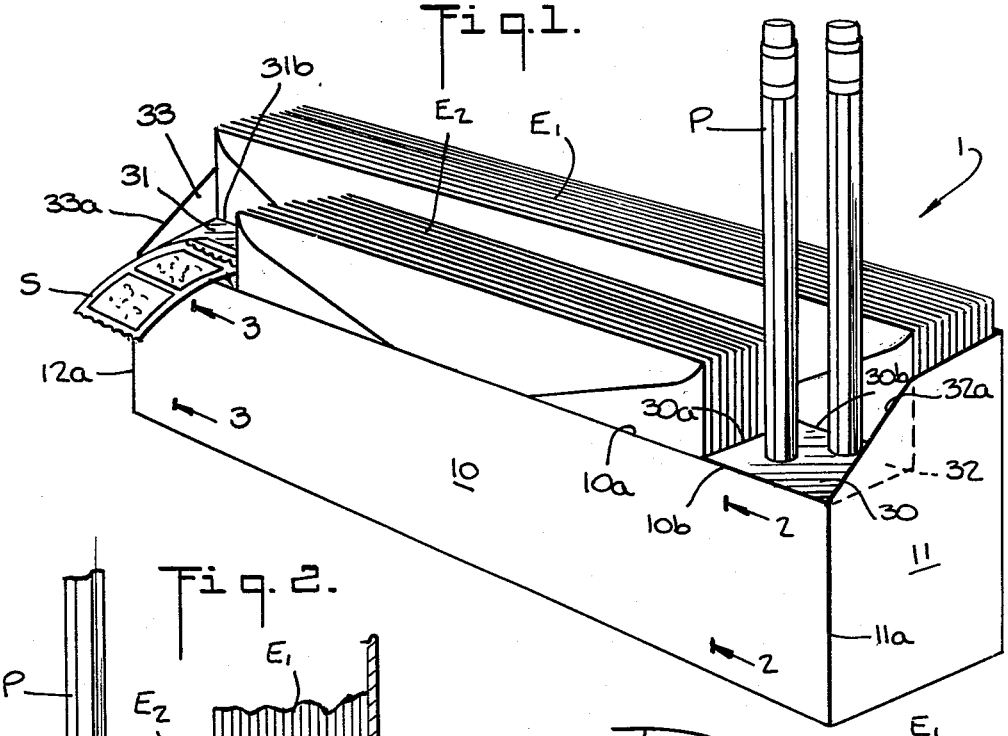
Fig. 2.
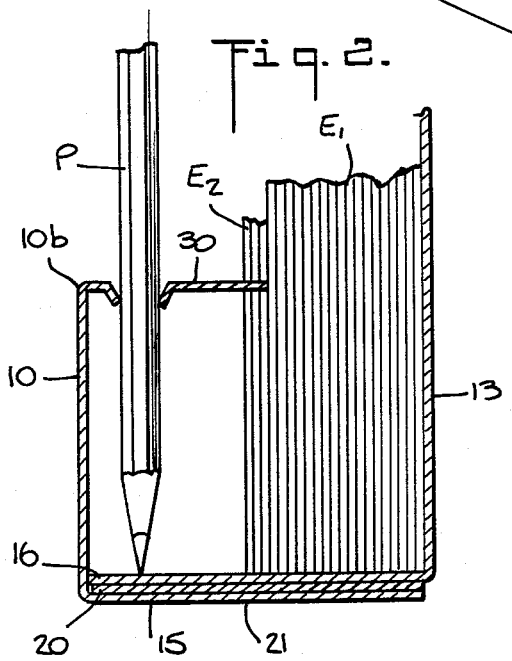
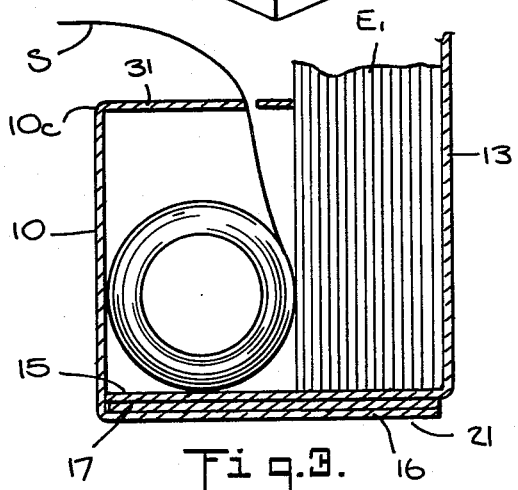
Fig. 3.
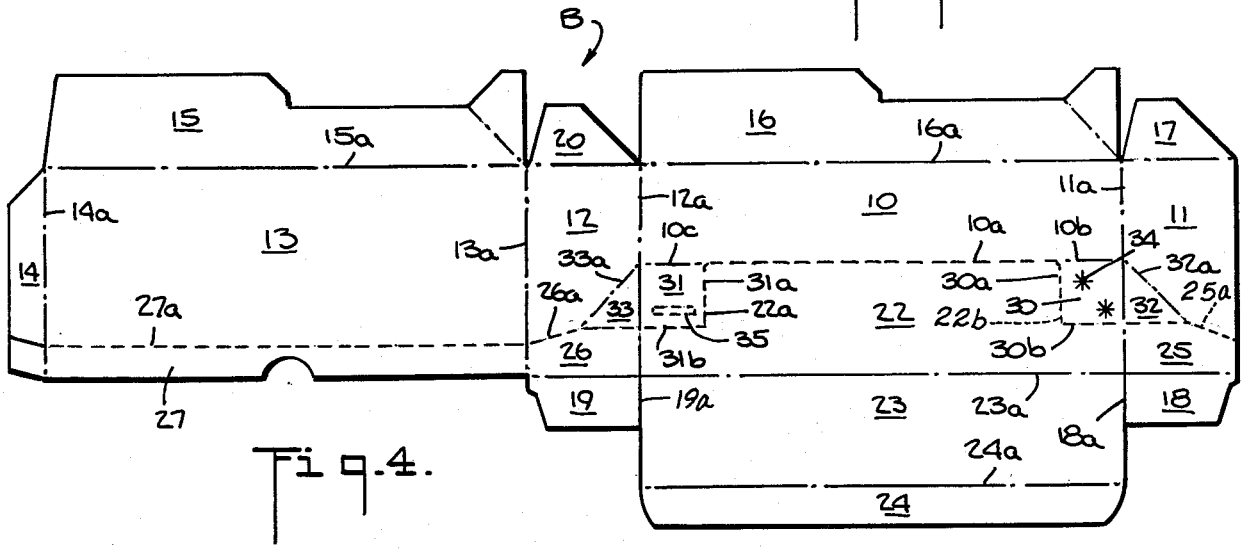
Fig. 4.

43
43a
12'
50
49
42
42a
10'
40
41
40a
41a
47
48
11'
2

44
46
40
41
47
10'
48
11'
45
2
B
60
31
A
10a
30

31"
53
51
54
52
21

12"
47e
43'
44"
47f
47g
45"
42'
46"
47h
10"
45'
11"
47c
47a
40'
41'
46'
44'
47d
47b
3
3

47c
11'
46'
47a
10"
44'
40'
41'
47d
45'
47b

DEFORMABLE CONTAINER

The abstract is not to be taken either as complete exposition or as a limitation of the present invention, however, the full nature and extent of the invention being discernable only by reference to and from the entire disclosure.

This invention relates to deformable containers suitable for use in containing articles having substantially different dimensions.

Envelopes are conventionally packaged in cardboard containers with only a single size envelope in a given container. Since there is frequently the need for envelopes of different sizes, such packaging requires that more than one container must be purchased. The necessity for two separate containers is particularly inconvenient for someone who is travelling or someone who is living away from home, for example, a student living in a dormitory where space is limited. In use, if different sized envelopes are placed into a single container some difficulty may be experienced in maintaining the envelopes in their proper relative positions. For example, when envelopes are removed from the container they will have the tendency of shifting the remaining envelopes which may result in those envelopes no longer being neatly stacked and thus possibly damaged by being bent or crushed.

It is the primary object of the present invention to provide an improved container for packaging stacks of flat sheet materials of different dimensions such as, for example, envelopes of different size.

A further object of the present invention is to provide a container of the type referred to which can be readily converted into a desk caddie for neatly holding and retaining in proper relative position therein two stacks of envelopes of different dimensions.

Still a further object of the present invention is to provide a container of the type referred to which when used in conjunction with a suitable cover has a generally rectangular configuration suitable for shipping and storage but which can be readily converted to a desk caddie by merely deforming portions thereof.

A concomitant object of the present invention is to provide a blank for forming a container of the type referred to, together with its cover.

One of the objectives of the present invention is achieved by a container construction which is characterized by opposite pairs of upwardly extending tabs located at opposite longitudinal corner portions of the container. The tabs are manually deformable with respect to the remaining portions of the container from a position in which the tabs are coplanar with the respective walls of the container from which they extend, into a position in which the tabs are located in the interior of the container. Each pair of tabs includes a rectangular tab which, in the deformed position of the tabs, is located in a plane substantially parallel to the bottom panel of the container and has a transverse and a longitudinal free edge. The transverse edges of the spaced rectangular tabs form between themselves a space for retaining the smaller dimensioned articles while the longitudinal free edges of the spaced rectangular tabs are colinear and are parallel to the back wall of the container so as to form between themselves and such back wall a space for retaining the longer dimensioned articles.

The foregoing and other objects, characteristics and advantages of the present invention will be more clearly understood from the following detailed description thereof when read in conjunction with the accompanying drawings, in which:

FIG. 1 is a perspective view of a deformable container according to one embodiment of the present invention showing the container after being deformed into the shape of a desk caddie and holding various writing materials;

FIG. 2 is a transverse sectional view, taken in the direction of arrows 2—2, of one end portion of the container of FIG. 1;

FIG. 3 is a transverse sectional view taken in the direction of arrows 3—3, of the opposite end portion of the container of FIG. 1;

FIG. 4 is a top plan view of the blank from which a container embodying the present invention is formed together with its cover;

Figure 7:
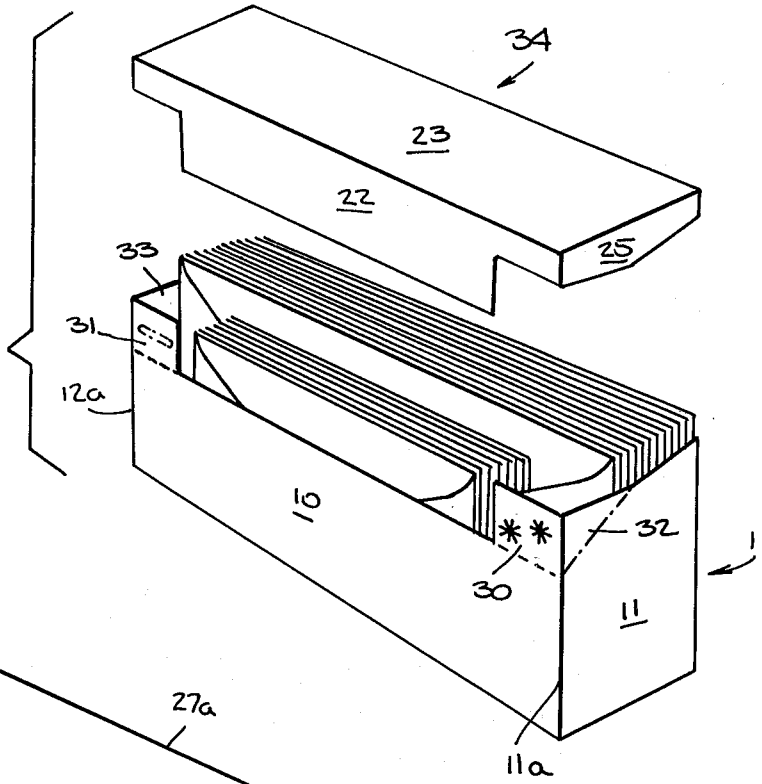
FIG. 7 is a perspective view of the container and cover of FIGS. 5 and 6 showing the cover detached from the container and the container filled with two stacks of envelopes of different sizes, but with the tabs still undeformed.

Referring initially to FIGS. 1–8, the blank of FIG. 4 includes a front wall 10 having integral side walls 11 and 12, respectively, at each of its side margins, defined by transverse fold lines **11*a* and 12*a*, respectively. Side wall 12 has an integral back wall 13 extending from its side margin remote from front wall 10 and defined by transverse fold line 13*a*. Side walls 11 and 12 are of substantially the same size and configuration and back wall 13 has substantially the same longitudinal length as front wall 10. Back wall 13 has an end flap 14, integral with the end margin of the back wall and defined by a traverse fold line 14*a*. A longitudinal flap 15 is integral with and extends along the bottom margin of back wall 13 defined by a longitudinal fold line 15*a*, while a substantially similarily shaped flap 16 is integral with and extends from the bottom longitudinal edge of front wall 10, defined by fold line 16*a*. The side walls 11 and 12 are provided with integral outer end flaps 17 and 20 respectively. The flaps 15, 16, 17 and 20 are so configurated that in assembled condition of the container they engage each other so as to together form the bottom panel 21 of the container 1. The flaps 17 and 20 are defined by a fold line which is a continuation of fold line 16*a***.

Longitudinally connected to the front wall 10 so as to form an extension thereof, is a panel 22 having stepped end portions 22a and 22b. Panel 22 is connected along its shorter longitudinal edge to front wall 10 along a perforated tear line 10a. Panel 22 has an integral panel 23 extending from its longer longitudinal edge remote from the wall 10 and defined by a fold line 23a. The panel 23 has, in turn, an integral longitudinal outer flap 24 extending from its edge remote from the panel 22, the longitudinal flap 24 being defined by fold line 24a. Panel 22 also has integral side panels 25 and 26 defined at each of its side margins by fold lines which are continuations of fold lines 11a and 12a respectively. Side panel 25 is located intermediate side wall 11 and a flap 18 which is integral with side panel 25 along fold line 23a. On its other side, panel 25 is connected to side wall 11 by perforated tear line 25a. Similarly, side panel 26 is located intermediate side wall 12 and a flap 19 which is integral with side panel 12 along fold line 23a. On its other side panel 26 is connected to side wall 12 by perforated tear line 26a. Extending from and integrally connected to the edge of side panel 26 which is remote from panel 22 is an elongated panel 27 which is connected to back wall 13 along a perforated tear line 27a. Flaps 25 and 26 are connected to panel 22 along fold lines 11a and 12a respectively. Similarly, flaps 26 and 27 are connected along fold line 13a and flaps 27 and 14 are connected along fold line 14a. Flaps 18 and 19 are separated from the panel 23 by the slits 18a and 19a, respectively.

The stepped end portions 22a and 22b of panel 22 form a pair of rectangular tabs 30 and 31 hinged to the front wall 10 along a pair of fold lines 10b and 10c which are located at opposite ends of and in registry with the tear line 10a. The tabs 30 and 31 are further defined, with respect to panel 22, by colinear longitudinal tear lines 30b and 31b, respectively, and by parallel transverse tear lines 30a and 31a, respectively. The fourth edge of each of the rectangular tabs 30 and 31 is defined by transverse fold lines 11a and 12a, respectively.

Triangular tabs 32 and 33 are hingedly connected to the rectangular tabs 30 and 31, respectively, along fold lines 11a, and 12a, respectively, and are hingedly connected to walls 11 and 12, respectively, along diagonal fold lines 32a and 33a, respectively.

According to the preferred embodiment, rectangular tab 30 includes a pair of star-shaped perforations 34, while rectangular tab 31 includes a tear portion in the form of an elongated slot 35.

When the container and cover are assembled, the end flap 14 is folded so that it overlies a portion of the edge of the side wall 11 to which it is preferably adhesively attached. Similarly, the flaps 15, 16, 17, and 20 are all folded upwardly out of the plane of the paper, as viewed in FIG. 4, so that when the walls 10, 11, 12 and 13 are folded into tubular condition the end flaps 17 and 20 will overlie the depending adjacent end portions of the flaps 15 and 16 for adhesive connection therewith. At the same time the flaps 15 and 16 will be interconnected, with the wider portion of flap 15 overlying part of the thinner portion of flap 16 and vice-versa.

After the container and cover are thus assembled, it may be filled as, for example, with two stacks of envelopes of different dimensions. The flaps 18 and 19 are then folded inwardly and the panel 23 is folded over the contents of the container with the longitudinal edge flap 24 being inserted adjacent the inner side face of the flap 27. In this condition, as seen in FIGS. 5 and 6, the filled container - cover assembly is generally rectangularly shaped and exhibits continuous flat sides and top and bottom panels.

Figure 5:
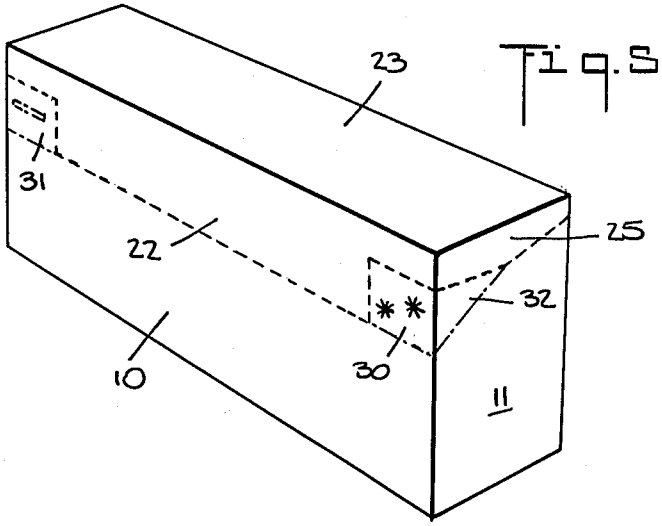
FIG. 5 is a perspective view, from above, of a container and its cover, set up from the blank of FIG. 4.
Figure 6:
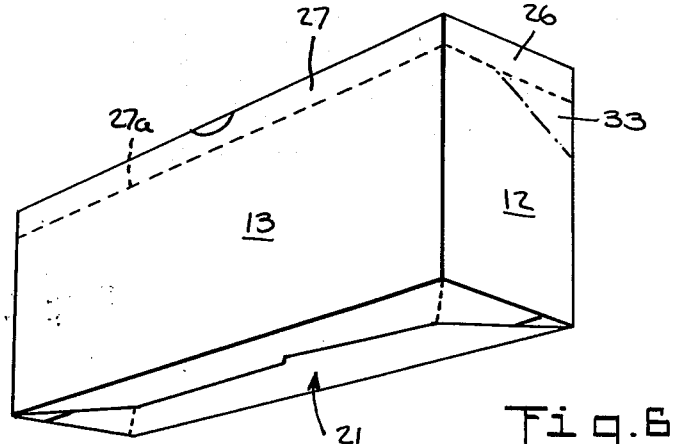
FIG. 6 is a perspective view, from below, of the container and cover of FIG. 5.

As will be evident from FIGS. 5 through 7, when the cover 34 (comprised of the flaps and panels 18, 19, 22, 23, 24, 25, 26 and 27) is separated from container 1 by tearing along the tear lines 25a, 30b, 30a, 10a, 31a, 31b, 26a and 27a, there remains a nowopen, still substantially rectangular container 1. After the cover 34 has been detached in the manner indicated in FIG. 7, the remaining generally rectangular container 1 displays rectangular tabs 30 and 31 still extending upwardly from the front wall 10 at opposite longitudinal ends of the latter, and still coplanar with wall 10.

Figure 8:
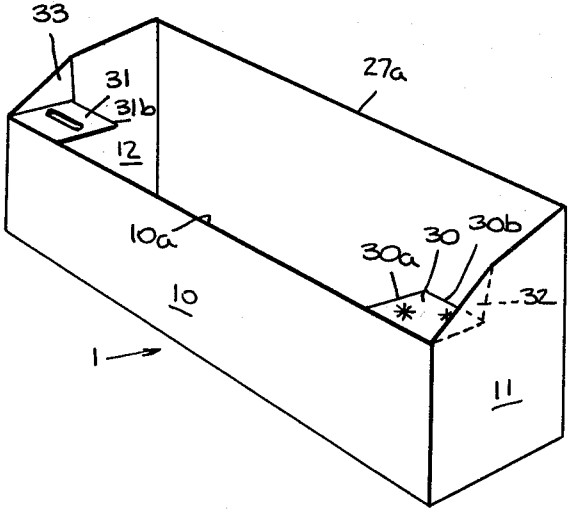
FIG. 8 is a perspective view of the container of FIG. 7 after the tabs have been deformed.

In use, the user merely presses inwardly with finger pressure against the upper corners formed by the fold lines 11a and 12a, respectively, (FIG. 7) until the pairs of tabs 30, 32, and 31, 33, respectively, are deformed toward the interior of the container and assume the position in the interior of the container illustrated in FIG. 8, in which the rectangular tabs 30, 31 are located in a single plane parallel to the plane of the bottom panel 21 of the container, while the triangular tabs 32 and 33, which act as support means for retaining the tabs 30 and 31 in the aforesaid plane, assume a position adjacent to the interior surfaces of end walls 11 and 12, respectively. It will be evident that during the deformation described, the tabs 30 and 31 pivot about the hinge connection 10b and 10c respectively, and also pivot with respect to tabs 32 and 33, respectively, about the hinge connection 11a and 12a, while the latter two tabs, in turn, pivot about their hinge connections 32a and 33a, respectively. The support means, i.e., tabs 32 and 33, maintain the rectangular tabs 30 and 31 in substantially secure, rigid condition when the latter are in said second, i.e., deformed position thereof, illustrated in FIG. 8. Consequently, in the deformed condition thereof, the tabs 30 and 31 present rigid abutment edges 30b and 31b, in registry with one another, for providing a longitudinal abutment, while the transverse edges 30a and 31a provide a pair of rigid transverse abutments. By choosing the spacing between the transverse edges 30a and 31a such as to correspond substantially to the length of the stack of envelopes $E_2$ of shorter length dimension, and by having the length of these transverse edges corresponding substantially to the thickness of the stack $E_2$ this stack will fit neatly between the aforesaid transverse abutment edges. Also, choosing the longitudinal length of the container 1 such that it corresponds substantially and is only slightly larger than the longitudinal length of the envelopes comprising the second, i.e., larger stack $E_1$ to be contained therein, this second stack of envelopes will fit neatly into the space between the longitudinal abutments 30b, 31b, and the back wall 13 of the container. Thus, the two stacks $E_1$ and $E_2$ of differently sized envelopes will be neatly maintained in proper relative position by the two sets of abutment edges. If desired, only a single pair of deformable tabs, for example, tabs 31 and 33 need be provided, or if both pairs of deformable tabs are provided only a single pair need be deformed. This may be desirable in cases where the envelopes in stack $E_2$ have a length which is longer than that illustrated in the drawings, corresponding, for example, to the distance between transverse edge 31a and side wall 11. It will also be evident that if it is desired to position more than two stacks of envelopes of different size in the container, the tabs 30, 31 can be stepped in shape (not illustrated) so as to present an additional set of transverse and longitudinal abutment edges suitable for the additional envelope size. For present purposes such stepped tabs will still be referred to as rectangular. It will further be evident that the container, according to the present invention could function satisfactorily even if it were not initially provided with a cover 34. For example, the container 1, according to the present invention could be filled and then covered with a cellophane wrapping instead of the cover 34. The procedure for deforming the tabs would be the same as described above, after removal of the cellophane.

Figures 9, 10, 11, 12, 13, 14:
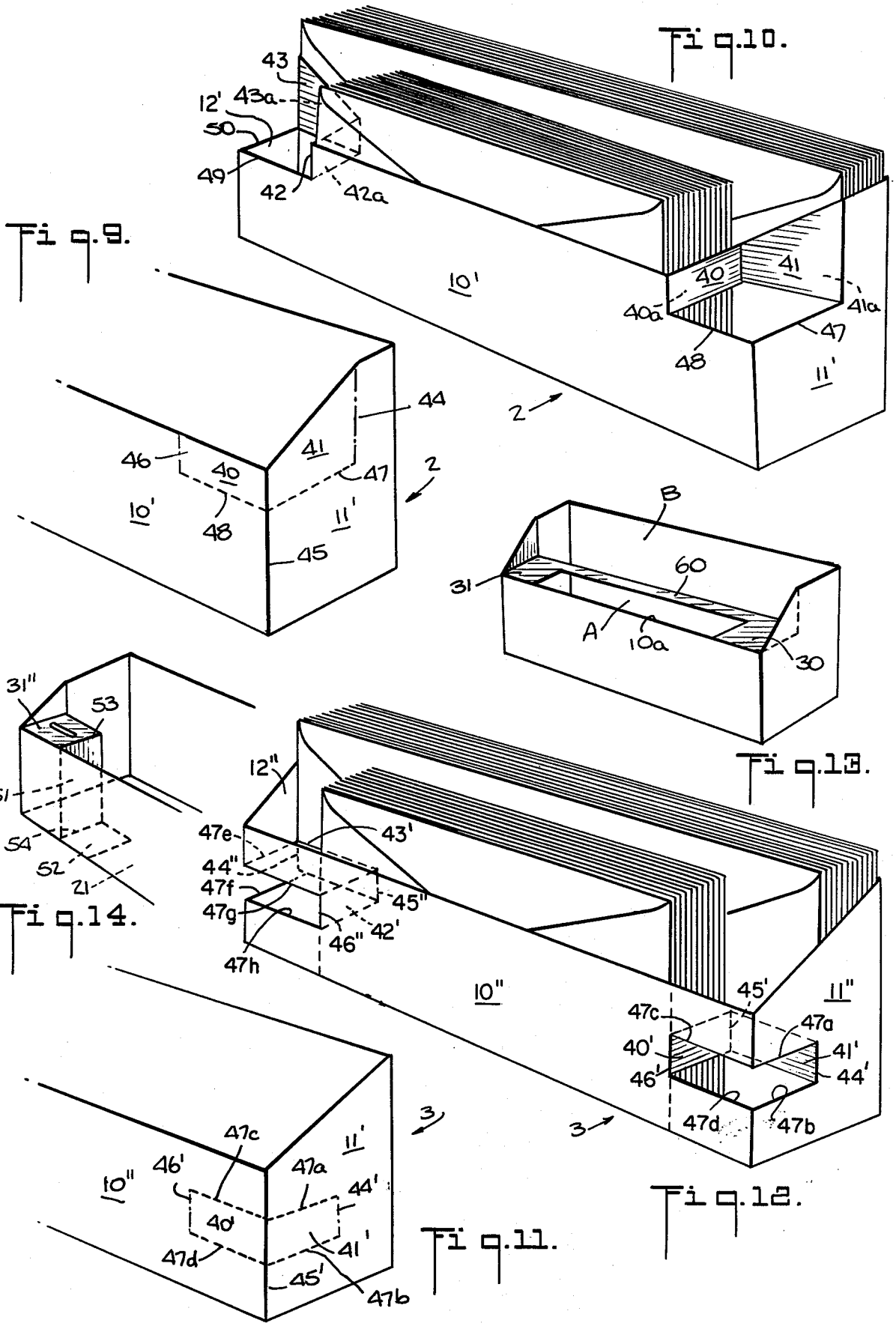
FIG. 9 is a partial perspective view of one end of a container according to another embodiment of the present invention showing the tabs thereof in undeformed condition.
FIG. 10 is a perspective view of the container according to FIG. 9 showing the tabs in deformed condition.
FIG. 11 is a partial perspective view of one end of a container according to still another embodiment of the present invention showing the tabs thereof in undeformed condition.
FIG. 12 is a perspective view of the container of FIG. 11 showing the tabs in deformed condition.
FIG. 13 is a perspective view of still another embodiment of the invention.
FIG. 14 is a perspective, partial, view of still a further embodiment of the invention.

A second embodiment of the present invention is shown in FIGS. 9 and 10, and a third embodiment of the present invention is shown in FIGS. 11 and 12. In these figures parts which are substantially identical to those in FIGS. 1 through 8 are given the same reference numerals as in FIGS. 1 through 8. The construction of the container for the second embodiment is substantially identical to that of the embodiment shown in FIGS. 1 through 8 but differs in that the flaps 40,41 and 42, 43 which are cut out of the adajacent front and side walls 10', 11' and 12' respectively are utilized in place of the tabs 30, 32 and 31, 33, respectively. As will be evident from FIGS. 9 and 10, in the embodiment illustrated the pairs of tabs 40, 41 and 42, 43 are hinged for movement in the horizontal direction by being connected to each other and to the respective container wall only along substantially vertical fold lines 44, 45 and 46. Horizontal slits or preferably tear lines 47, 48 and 49, 50 separate the lower horizontal edges of the tabs from the corresponding container walls.

According to this embodiment of the invention the pairs of tabs 40, 41 and 42, 43 located at opposite longitudinal ends of the container 2 cooperate with each other to provide transverse and longitudinal abutment surfaces **40*a*, 41*a*, and 42*a*, 43*a*. These latter surfaces are each vertically oriented and thus provide a surface contact with the envelopes positioned in the container. The tabs 40,41 and 42,43 on opposite sides of the container 2 may thus be deformed toward the interior of the container so that the longitudinal and transverse inner side faces 40*a*, 41*a*, 42*a*, 43*a* of these tabs respectively form the abutments previously described with respect to the edges 30*a*, 30*b*, 31*a* and 31*b*** respectively, and for the same purposes.

A further embodiment of the present invention is illustrated in FIGS. 11 and 12. In this embodiment a container 3 is substantially identical to container 2 described above except that instead of the tab 40', 41' and 42,43' the tabs 40, 41 and 42, 43 being located in the region of the top edges of the corresponding adjacent front and side walls 10'', 11'' and 12'' of the container, the tabs 40', 41' and 42', 43' of the container 3 are located intermediate the top and bottom edges of the corresponding front and side walls of the container. The tabs 40' and 41' are hinged to each other and to the walls of the container along vertical fold lines 44', 45' and 46' respectively and are further defined by horizontal tear lines **47*a*, 47*b*, 47*c* and 47*d* forming the upper and lower longitudinal edges of said tabs. Correspondingly, the tabs 42' and 43' are hinged to each other and to the walls of the container along vertical fold lines 44'', 45'' and 46'' respectively and are further defined by horizontal tear lines 47*e*, 47*f*, 47*g* and 47*h* forming the upper and lower longitudinal edges of these tabs. It will be apparent that the paired tabs 40', 41' and 42', 43' can be deformed toward the interior of the container 3 in essentially the same fashion and for the same abutment-forming purpose as the tabs, 40, 41 and 42, 43** described above.

Reverting for the moment to the embodiment of FIGS. 1 to 8, it will be evident from FIGS. 1 to 3 that, as an added convenience to the user, a roll of postage stamps S may be positioned in the space formed within the container 1 beneath the tab 31 and the stamps fed out through the opening 35. Also, pens or pencils P may be held in vertical position in the openings 34 provided in tab 30 by pushing the pen or pencil into such opening as seen in FIG. 2. Analogous storage-like use can, of course, be made of the corner recesses formed in the containers 2 and 3, although it will be clear that for obvious reasons pens or pencils will not be disposable in a standing condition as shown in FIGS. 1 and 2.

According to still another embodiment of the invention illustrated in FIG. 13 a narrow longitudinal strip 60 extends between and connects the longitudinal edge portions of the tabs 30' and 31' at a location spaced from the top edge **10*a* of the front wall of the container. This strip 60 thus forms, in deformed condition of the tabs 30' and 31'**, a longitudinal divider for separating the container into two distinct compartments A and B for holding the envelope stacks $E_2$ and $E_1$, respectively.

A still further embodiment of the invention is illustrated in FIG. 14. In this embodiment, which in essence is the same as the embodiment of FIGS. 1 to 8, each of the abutment-forming tabs (of which only the stamp-passing one denoted 31'' is shown has a pair of flaps 51 and 52 connected thereto along a fold line 53. The flaps 51 and 52 are in turn connected to each other along a fold line 54 and are dimensioned such that when folded into the position shown in FIG. 14, the flap 52 lies flush against the bottom wall 21 and the flap 51 forms a vertical support for the respective tab to which it is connected. When a stack of envelopes $E_2$ is positioned in the space between the tabs these envelopes rest on the flaps 52 and at the same time have their lateral edges in abutment with the flaps 51 so as to hold the flaps 51,52 in fixed position for further supporting the respective tabs.

It should also be noted that because of the inherent resilient properties of the cardboard or similar material of the container, according to the preferred embodiment of the present invention, portions of the front and side walls of the container flex during the deformation of the corner portions. These flexed walls then spring back to substantially their original condition when the corner portions approach their fully deformed position, with the result that the corner portions are locked by said walls into said deformed position thereof.

Furthermore, the natural resiliency which a stack of paper envelopes displays, in the direction of the thickness of the stack, acts to maintain the stack $E_1$ pressed against the longitudinal abutments formed by the tabs 30 and 31 even after numerous envelopes in such stack have been removed.

While the invention has been illustrated and described in detail in the drawings and foregoing description, the same is to be considered as illustrative and not restrictive in character, it being understood that, although various embodiments have been shown and described, all changes and modifications that come within the spirit of the invention and the scope of the claims are also desired to be protected.

What is claimed is:

1. A generally rectangular container for holding articles of different dimension, said container having an elongated front wall, an elongated back wall and parallel sidewalls connected in tubular relation, and a container bottom panel;

a generally rectangular tab extending from and hingedly connected along one of its edges to one of said walls and having a pair of free edges;

support means hingedly connecting said tab to another of said walls adjacent to said one wall for supporting said tab for movement between a first position in which said tab is coplanar with said one wall and a second position in which said tab is located in the interior of said container in a plane which is parallel to said bottom panel, whereby when said tab is in said second position thereof said free edges thereof form in the interior of said container a longitudinal and a transverse abutment, respectively, for positioning in said container articles having different dimensions.

2. The structure according to claim 1 wherein said support means comprises a tab having a generally triangular configuration.

3. The structure according to claim 2 wherein said triangular tab is hingedly connected along its longest edge to said other wall along a diagonal fold line and is hingedly connected along one of its shorter edges to an edge of said rectangular tab, said connection between said tabs being along a fold line which is colinear, when said rectangular tab is in said first position thereof, with the line along which said adjoining walls are connected to one another.

4. The structure according to claim 3, wherein said rectangular tab extends from and is hingedly connected to said front wall and said triangular tab extends from and is hingedly connected to an adjacent sidewall along a diagonal fold line.

5. The structure according to claim 1 further comprising a generally rectangular cover member having a top panel and walls means surrounding said top panel for detachably connecting said cover member to the walls of said container, whereby said cover member normally closes the top of said container and may be detached therefrom for exposing the interior of said container.

6. The structure according to claim 5 wherein said cover member is detachably connected to said container walls along tear lines, said free edges of said rectangular tab being formed in response to detaching of said cover member.

7. The structure according to claim 1 wherein said rectangular tab extends upwardly from and is hingedly connected to said front wall along the upper longitudinal edge thereof at one longitudinal end of said front wall, said structure further comprising a second generally rectangular tab extending upwardly from and hingedly connected along said upper longitudinal edge thereof to said front wall at the other longitudinal end of said front wall, said second tab having a free longitudinal edge and a free transverse edge, and support means hingedly connecting said second tab to the sidewall adjacent to said other longitudinal end of said front wall for supporting said second tab for movement between a first position in which said second tab is coplanar with said front wall and a second position in which said second tab is located in the interior of said container in the same plane as said first tab when the latter is in said second position thereof, said second tab being dimensioned such that when both said tabs are in said second position thereof the free longitudinal edge of said second tab is in registry with the free longitudinal edge of said first tab and the free transverse edges of said pair of tabs are parallel to and face each other so as to define between themselves a distance of smaller dimension than the distance between said side walls.

8. The structure according to claim 7 wherein the dimensions of the container are such that the container will be capable of holding in fixed relative position therein a first stack of envelopes of a length approximating the distance between said side walls and a shorter second stack of envelopes of a length approximating the distance between said transverse edges of said pair of rectangular tabs, said first stack of envelopes being positioned parallel to said back wall in the space defined between said back wall and said free longitudinal edges of said pair of tabs, and said shorter second stack of envelopes being positioned parallel to said first stack between said first stack and said front wall in the space defined between said transverse free edges of said pair of rectangular tabs.

9. The structure of claim 1 further comprising a second pair of hinged tabs substantially identical to the first pair and located at the opposite longitudinal end of said front wall of said container, whereby when both of said pairs of tabs are in said second position thereof, said free longitudinal edges of said first tabs, are in substantial alignment with one another along a line spaced a given distance from said back wall, said given distance corresponding to the thickness of a stack of flat sheet items having a length generally corresponding to the longitudinal length of said container, and said free transverse edges of said first tabs being parallel to each other and spaced a distance substantially corresponding to the length of a second stack of flat sheet items having a stack width no greater than the length of said transverse edges, so that in said second position of said tabs two stacks of sheet items of different dimensions can be accommodated in said container and maintained in predetermined positional relationship with one another.

10. A generally rectangular container for holding items of different dimensions, said container having an elongated front wall, an elongated back wall and parallel sidewalls connected in tubular relation, and a container bottom panel;

a first tap hingedly connected to one of said walls and a second tab hingedly connected to an adjacent one of said walls and to said first tab, said tabs being selectively movable from a first position in whch said tabs are coplanar with the respective walls to which they are connected to a second position in which said tabs are located at the interior of said container, said tabs being hingedly connected to each other along a fold line which is, when said tabs are in said first position thereof, colinear with the line at which said adjacent pair of walls are connected to one another, said first tab being hingedly connected along a longitudinal fold line to said one wall and said second tab being hingedly connected along a diagonal fold line to said adjacent wall, said first tab having a pair of free edges one of which is parallel to said longitudinal fold line and the other one of which is parallel to said colinear fold line when said tabs are in said first position, said fold lines being arranged such that when said pair of hinged tabs is placed into said second position thereof said second tab cooperates with said first tab to support said first tab in a plane which is parallel to said bottom panel, whereby one of said free edges of said first tab is parallel to and located intermediate said front and back walls and the other of said free edges of said first tab is parallel to and located intermediate said side walls, whereby said free edges of said first tab act as rigid abutments for maintaining in proper relative positions items of different dimensions located in the interior of said container.

11. The structure according to claim 1 further comprising a first generally rectangular flap having a first lateral edge hingedly connected to one of said free edges of said tab, and a second lateral edge parallel and spaced from said first edge, said flap being dimensioned such that when said tab is in said second position thereof said flap extends downwardly with said second lateral edge thereof being in contact with said bottom panel; and a second flap hingedly connected to said first flap along said second lateral edge of the latter, said second flap being adapted to lie flat on said bottom panel when said tab is in said second position thereof whereby said first and second flaps will rigidly support said tab in said second position when some of the articles in the container rest on top of said second flap while being in abutment with said first flap.

12. The structure according to claim 7 further comprising a longitudinal strip extending between and connected at opposite ends thereof to respective ones of said pair of rectangular tabs at a location spaced from said front wall and parallel thereto when said tabs are both in said second position thereof.

13. In a die-cut blank made from cardboard or similar sheet-like material and adapted to be folded into a closed container for holding articles of different dimensions, said blank including:

a substantially rectangular sheet of said material having parallel top and bottom edges and parallel lateral edges;

three vertical, parallel, spaced-apart fold lines arranged intermediate said lateral edges defining four rectangular wall panels;

said four wall panels including a front wall panel, a back wall panel, a first side wall panel positioned between said front and back wall panels and a second side wall panel; the improvement comprising:

a continuous tear-line extending generally horizontally across all four of said wall panels from one of said lateral edges to the other for forming a container portion on one side of the tear-line and a detachable cover portion on the other side of the tear-line;

said tear-line in said front panel having a horizontal medial portion and being stepped vertically in the region of each of the vertical fold lines defining said front wall panel, for forming in said front wall panel adjacent each of said vertical fold lines the outline of a pair of substantially rectangular tabs extending upwardly from said horizontal medial portion of said tear-line toward said top edge of said sheet, said front panel further having a pair of horizontal fold lines colinear with said medial portion of said tear-line and extending from opposite ends of said tear-line to the corresponding adjacent one of said vertical fold lines for defining the bottom edge of each of said rectangular tabs; and said side wall panels each having an additional fold line extending diagonally between said tear-line and the corresponding one of said vertical fold lines defining said front wall panel for forming in said side wall panels the outline of a triangular tab adjacent each of the respective rectangular tabs.

* * * * *

UNITED STATES PATENT AND TRADEMARK OFFICE

CERTIFICATE OF CORRECTION

PATENT NO. : 4,111,299

DATED : September 5, 1978

INVENTOR(S) : DAVID TAUB

It is certified that error appears in the above-identified patent and that said Letters Patent are hereby corrected as shown below:

Column 5, lines 50-51, for "except that instead of the tab 40', 41' and 42, 43' the tabs 40, 41 and 42, 43 being" read --except that instead of the tabs 40', 41' and 42', 43' (corresponding to the tabs 40, 41 and 42, 43) being--.

Column 6, line 30, for "shown" read --shown)--.

Column 8, line 52, for "tap" read --tab--; line 55, for "whch" read --which--.

Signed and Sealed this

*Third* Day of *April 1979*

[SEAL]

*Attest:*

RUTH C. MASON
*Attesting Officer*

DONALD W. BANNER
*Commissioner of Patents and Trademarks*